US010233574B2

(12) United States Patent
Wan et al.

(10) Patent No.: US 10,233,574 B2
(45) Date of Patent: Mar. 19, 2019

(54) KNITTING APPARATUS FOR CYLINDRICAL BIAXIAL THREE-DIMENSIONAL WEFT KNITTED STRUCTURE

(71) Applicant: JIANGNAN UNIVERSITY, Wuxi, Jiangsu (CN)

(72) Inventors: Ailan Wan, Jiangsu (CN); Honglian Cong, Jiangsu (CN); Gaoming Jiang, Jiangsu (CN); Jiang Tian, Jiangsu (CN)

(73) Assignee: JIANGNAN UNIVERSITY, Wuxi, Jiangsu (CN)

( * ) Notice: Subject to any disclaimer, the term of this patent is extended or adjusted under 35 U.S.C. 154(b) by 99 days.

(21) Appl. No.: 15/524,515

(22) PCT Filed: Jan. 8, 2015

(86) PCT No.: PCT/CN2015/070356
§ 371 (c)(1),
(2) Date: May 4, 2017

(87) PCT Pub. No.: WO2016/086512
PCT Pub. Date: Jun. 9, 2016

(65) Prior Publication Data

US 2017/0321356 A1 Nov. 9, 2017

(30) Foreign Application Priority Data

Dec. 2, 2014 (CN) ..... 2014 1 0723288

(51) Int. Cl.
*D04B 1/22* (2006.01)
*D04B 15/58* (2006.01)
(Continued)

(52) U.S. Cl.
CPC ..... *D04B 1/22* (2013.01); *D04B 1/123* (2013.01); *D04B 9/06* (2013.01); *D04B 9/16* (2013.01);
(Continued)

(58) Field of Classification Search
CPC . D04B 1/22; D04B 1/23; D04B 1/225; D04B 9/16; D04B 9/42
See application file for complete search history.

(56) References Cited

U.S. PATENT DOCUMENTS 219,619 A * 9/1879 Chase ..... D04B 9/16 66/10
222,327 A * 12/1879 Stowe ..... D04B 1/18 66/190
(Continued)

FOREIGN PATENT DOCUMENTS

CN 1570240 A 1/2005
CN 101876120 A 11/2010
GB 1384522 A 2/1975

OTHER PUBLICATIONS

Langsen Liu, et al; "Biaxial circular weft knitted high performance polyethylene fabric and development of its producing equipment", Journal of Textile Research, vol. 30, No. 7, Jul. 2009, pp. 129-134.
(Continued)

*Primary Examiner* — Danny Worrell
(74) *Attorney, Agent, or Firm* — Ladas & Parry LLP

(57) ABSTRACT

A knitting method and an apparatus for a cylindrical biaxial weft-knitted three-dimensional knitted structure. The biaxial three-dimensional knitted structure comprises two weft plain stitch structures (7, 7'), a group of spacer yarns (416), two groups of weft inserting yarns (415, 415') and a group of warp inserting yarns (43), wherein the two groups of weft inserting yarns are used for selective weft inserting on a needle dial (11) or a needle cylinder (13), the warp inserting yarns are positioned between the two groups of weft inserting yarns, the two weft plain stitch structures are connected with each other by the group of spacer yarns, for jointly clamping the weft inserting yarns and the warp inserting yarns, in order to form a biaxial weft-knitted three-dimen-
(Continued)

sional knitted structure. Such three-dimensional knitted structure improves the mechanical properties of three-dimensional knitted fabrics; by increasing the interval between the needle dial and the needle cylinder, the thickness of the knitted structure is increased, which is suitable for the reinforced structure of high-performance structural and functional composite materials, and expand the field of the use of the knitted structures.

5 Claims, 5 Drawing Sheets

(51) Int. Cl.

| | |
|---|---|
| ***D04B 15/88*** | (2006.01) |
| ***D04B 9/16*** | (2006.01) |
| ***D04B 9/42*** | (2006.01) |
| ***D04B 15/14*** | (2006.01) |
| ***D04B 15/80*** | (2006.01) |
| ***D04B 15/94*** | (2006.01) |
| ***D04B 1/12*** | (2006.01) |
| ***D04B 9/06*** | (2006.01) |
| ***D04B 15/42*** | (2006.01) |

(52) U.S. Cl.
CPC ..... *D04B 9/42* (2013.01); *D04B 15/14* (2013.01); *D04B 15/42* (2013.01); *D04B 15/58* (2013.01); *D04B 15/80* (2013.01); *D04B 15/88* (2013.01); *D04B 15/94* (2013.01); *D10B 2403/021* (2013.01); *D10B 2403/02412* (2013.01); *D10B 2505/02* (2013.01)

(56) References Cited

U.S. PATENT DOCUMENTS

| | | | | |
|---|---|---|---|---|
| 430,300 | A * | 6/1890 | Rhome | D04B 1/225 66/10 |
| 3,709,262 | A * | 1/1973 | Braunschweiler | D03D 37/00 139/14 |
| 3,832,867 | A | 9/1974 | Luchi | |
| 3,884,053 | A * | 5/1975 | Niederer | D04B 9/10 66/190 |
| 3,943,733 | A * | 3/1976 | Wily | D04B 9/18 66/125 R |
| 3,949,570 | A | 4/1976 | Niederer | |
| 3,961,498 | A | 6/1976 | Braunschweiler | |
| 4,015,443 | A * | 4/1977 | Luchi | D04B 9/18 66/10 |
| 5,345,791 | A * | 9/1994 | Mathieu | B29C 53/8058 66/190 |
| 5,623,840 | A | 4/1997 | Roell | |
| 7,591,152 | B2 * | 9/2009 | Hu | D04B 9/06 66/17 |

OTHER PUBLICATIONS

First Chinese Office Action dated Feb. 24, 2016, Appln. 201410723288.5.

International Search Report dated Sep. 14, 2015; PCT/CN2015/070356.

International Preliminary Report on Patentability dated Jun. 6, 2017; PCT/CN2015/070356.

* cited by examiner

KNITTING APPARATUS FOR CYLINDRICAL BIAXIAL THREE-DIMENSIONAL WEFT KNITTED STRUCTURE

FIELD

The present invention belongs to the field of knitting and relates to a knitting mechanism and, more particularly, to a knitting method and an apparatus for a cylindrical biaxial weft-knitted three-dimensional knit structure.

BACKGROUND

Knitted spacer structure is a three-dimensional knit structure constructed from a spacer yarn layer formed between the superficial layers of two separate knit structures connected together by means of yarns. There are many varieties of knitted spacer structures and they use a wide range of raw materials enabling easy changes of width, density and interval width. With the combinative application of resin impregnation, surface coating and lamination processes, they obtain wearabilities and mechanical and physical properties such as air permeability, moisture-absorption ability, moisture permeability, shock resistance, filterability, compressive modulus of elasticity, fireproofing and thermal insulating properties, and are thus extensively used in reinforced structures of industrial knitting materials and structural composite materials.

At present, there are three typical knitted spacer structures. The first is the warp-knitted spacer structure knitted on a double needle bed warp knitting machine, and in this fabric structure warp plain stitch can be used for ground stitch, and chain weft inlay stitch and other stitches can also be used. The second is the weft-knitted spacer structure knitted on a flat weft knitting machine, and in this fabric structure tuck stitch is used for yarn connection and rib stitch and other stitches can also be used. These two types of knitted spacer structures differ in ground stitches and the way of connection yarn feeding, while their common disadvantage is that the superficial layers thereof are both yarn loops without any straightened reinforcement yarns fed, and the bent structure of knitted loops hinders the full utilization of the mechanical properties of yarns, thus resulting in the poorer mechanical properties of their superficial structures. The third is the biaxial reinforced weft-knitted spacer structure formed by two biaxial reinforced weft-knitted single-face knitted structures separately knitted by two needle beds and thereafter connected by connection yarns on a flat weft knitting machine, in which case cylindrical or tube-like biaxial weft-knitted spacer structures cannot be formed.

SUMMARY OF THE INVENTION

The technical problem the present invention aims to resolve is to avoid the aforementioned disadvantages of ordinary knitted spacer structures by providing a knitting method and apparatus for a new cylindrical biaxial three-dimensional knit structure.

To this end, the present invention provides a cylindrical biaxial weft-knitted three-dimensional knit structure comprising two weft plain stitches, a group of spacer yarns, two groups of weft inlay yarns and a group of warp inlay yarns, wherein the two groups of weft inlay yarns are used for the selective weft inlay on a needle dial or a needle cylinder, the warp inlay yarns are positioned between the two groups of weft inlay yarns, and the two weft plain stitches are connected with each other by the group of spacer yarns to jointly hold the warp inlay yarns and one group of weft inlay yarns or both the two groups of weft inlay yarns together, in order to form a biaxial weft-knitted three-dimensional knit structure.

Preferrably, needle dial looped yarns are fed into knitting needles of the needle dial through a needle dial looped yarn guide and a weft plain stitch is formed under the effect of a needle dial stitch cam; needle cylinder looped yarns are fed into knitting needles of the needle cylinder through a needle cylinder looped yarn guide and a weft plain stitch is formed under the effect of a needle cylinder stitch cam.

Preferrably, the weft inlay yarns are inlaid into the weft plain stitch in a straight way; the warp inlay yarns are inlaid between each longitudinal row along the face side of the looped yarn and each longitudinal row along the reverse side of the looped yarn in a straight way, and are held by one group of weft inlay yarns or two groups of weft inlay yarns and the spacer yarns (416); the weft inlay yarns are located on the reverse sides of the yarn loop pillar and sinker loop of the weft plain stitch.

Preferrably, the spacer yarns are fed into knitting needles of the needle dial and knitting needles of the needle cylinder through a spacer yarn guide and connect the two weft plain stitches in the form of tuck stitches under the respective effects of a needle dial tuck cam and a needle cylinder tuck cam, and hold the warp inlay yarns and the two groups of the weft inlay yarns, thereby forming a biaxial weft-knitted three-dimensional knit structure.

The present invention also provides an apparatus for producing fabrics having the cylindrical biaxial weft-knitted three-dimensional knit structure comprising a loop forming device, a transmission mechanism, a draw-off and take-up mechanism, a yarn feeding mechanism, a control mechanism, and a body frame.

Further, the loop forming device comprises a needle dial, a needle cylinder, needle dial knitting needles, needle cylinder knitting needles, a needle dial tuck cam, a needle cylinder tuck cam, a needle dial tri-pedestal, a needle cylinder tri-pedestal, a needle cylinder tri-pedestal disc, the needle dial tuck cam and a needle dial stitch cam being connected to the needle dial tri-pedestal by means of screws, the needle cylinder tuck cam and a needle cylinder stitch cam being connected to the needle cylinder tri-pedestal by means of screws, the needle cylinder tri-pedestal being connected to the needle cylinder tri-pedestal disc by means of screws; the needle dial stitch cam controls the needle dial knitting needles to knit the weft plain stitch by loop formation; the needle cylinder stitch cam controls the needle cylinder knitting needles to knit the weft plain stitch by loop formation; the needle dial tuck cam and the needle cylinder tuck cam control the needle dial knitting needles and the needle cylinder knitting needles to form a double-sided structure with a tuck height for connecting the two weft plain stitches.

Further, the yarn feeding mechanism comprises a needle cylinder looped yarn guide, a needle dial looped yarn guide, a needle cylinder weft inlay yarn guide, a needle dial weft inlay yarn guide and a spacer yarn guide which are arranged counterclockwisely; the yarn feeding mechanism further comprises a warp yarn disc with a plurality of holes uniformly distributed thereon, the warp yarn disc being connected with three columns through three uniformly distributed bracing struts; warp inlay yarns are dispensed from a warp yarn creel through a yarn feeder tube and pass through a yarn hook on a warp inlay yarn guide ring and then penetrate through the holes on the warp yarn disc; needle cylinder looped yarns are kept in a cylinder plugged on the needle cylinder tri-pedestal disc, and are then fed to the loop forming system; needle dial looped yarns are kept in a cylinder plugged on a bobbin creel fixedly connected with a shaft sleeve and reach the needle dial looped yarn guide through a yarn hook on a yarn lever, and are then fed to the loop forming system; needle cylinder weft inlay yarns are kept in a cylinder plugged on the needle cylinder tri-pedestal disc, and are then inlaid between the warp inlay yarns and the needle cylinder looped yarns through the needle cylinder weft inlay yarn guide; needle dial weft inlay yarns are kept in a cylinder plugged on a bobbin creel fixedly connected with the shaft sleeve and reach the needle dial weft inlay yarn guide through a yarn hook on a yarn lever, and are then inlaid between the warp inlay yarns and the needle dial looped yarns; spacer yarns are kept in a cylinder plugged on the needle cylinder tri-pedestal disc, and are then the loop forming system through the spacer yarn guide; the needle cylinder looped yarn guide, the needle cylinder weft inlay yarn guide, needle cylinder looped yarns, needle cylinder weft inlay yarns, spacer yarns, the needle cylinder tuck cam, the needle cylinder stitch cam and the needle cylinder tri-pedestal, and the needle dial looped yarn guide, the needle dial weft inlay yarn guide, needle dial looped yarns, needle dial weft inlay yarns, the needle dial tuck cam, the needle dial stitch cam and the needle dial tri-pedestal rotate synchronously with the needle cylinder tri-pedestal disc and a needle dial tri-pedestal disc, respectively.

Further, the transmission mechanism comprises a squirrel-cage 3-phase A.C. asynchronous motor fixed on the seat by means of the seat connector screws, a drive shaft driven by the A.C. asynchronous motor with a belt, the drive shaft being provided with two identical pinions, the pinions being engaged respectively with a needle cylinder main gear and a needle dial main gear which are identical, the needle cylinder main gear being connected with the needle cylinder tri-pedestal disc by means of keys, the needle cylinder main gear and the needle cylinder tri-pedestal disc being driven by the pinion on the drive shaft to rotate along a steel track located at a recess on the body frame; the needle dial main gear is connected with a needle dial tri-pedestal disc by means of keys, the needle dial tri-pedestal disc being fixedly connected with the upper end of the shaft sleeve, the lower end of the shaft sleeve being connected with the needle dial tri-pedestal by means of screws, and the needle dial main gear rotates under the effects of the A.C. asynchronous motor, the drive shaft and the pinion; the needle cylinder main gear and the needle dial main gear rotate synchronously with one another. To ensure the synchronism between the needle dial tri-pedestal and needle cylinder tri-pedestal and the invariance of clearances between the needle cylinder tuck cam and the needle cylinder and between the needle cylinder stitch cam and the needle cylinder during operation, two driven shafts are provided and they are connected with the frame body by means of bearings, and each of them is provided with two compensating pinions. The pinion on the drive shaft drives the needle cylinder main gear and the needle dial main gear to rotate, and the needle cylinder main gear and the needle dial main gear drive the respective compensating pinions on the two driven shafts to rotate respectively. The uniform distribution of the driven shafts and the compensating pinions thereon circumferentially with respect to the needle cylinder main gear and the needle dial main gear helps to improve the torsional rigidity between the needle cylinder tri-pedestal disc and the needle dial tri-pedestal disc, reduce transmission gap and ensure the synchronism between the needle cylinder main gear and the needle dial main gear. Bearings are installed on a hollow determinate shaft and positioned using bearing shoulders; interference fit of the bearings and the shaft sleeve ensures that the needle dial main gear is driven by the pinion on the drive shaft to rotate the shaft sleeve. The upper end of the determinate shaft is connected with the needle dial large gear housing by means of a bearing and connected to the top cover of the body frame by means of the top cover connector screws, while the lower end of the determinate shaft is connected with the needle dial by means of screws. The upper ends of the drive shaft and the two driven shafts are connected with the needle dial large gear housing by means of bearings respectively, and the lower ends thereof are connected with the body frame by means of bearings respectively.

Further, the draw-off and take-up mechanism comprises a draw-off roller, two compression rollers with both ends of each of the three rollers engaged with gear transmission, and the draw-off roller being driven by the left end of a torque stepper motor through a chain; a fabric roller protruding out of a body frame stanchion through a rocker lever, with a fabric roller left end located on the same side as the chain, the right end of the draw-off roller drives a fabric roller right end through a chain, a transmission shaft and a belt, and the tension of the belt can be adjusted by changing the locations of the belt tensioner pulleys.

Further, the control mechanism comprises a central control unit, an operation panel, a push button On/Off control, a torque motor draw-off/take-up control, a triangular position adjustment control, and a defect detection device control.

Further, the body frame comprises body frame connector screws, a seat fixedly connected with the body frame, seat connector screws, three columns evenly distrubuted circumferentially, a top cover, top cover connector screws, column connector screws fastening the columns onto a body frame platform, a head casing, and a needle dial large gear housing.

Further, the needle dial, the needle cylinder and the draw-off and take-up mechanism are fixed, and the needle dial is connected to the determinate shaft by means of the screws and the needle cylinder is connected to the body frame by means of the body frame connector screws; the stanchion of the draw-off and take-up mechanism is fixedly installed on the body frame; the interval between the needle dial and the needle cylinder can be adjusted to achieve knitting of a cylindrical biaxial weft-knitted three-dimensionally structured fabric with a maximum thickness not less than 2 cm.

Another technical scheme of the present invention provides a method for producing a cylindrical biaxial weft-knitted three-dimensional knit structure, the method comprising: Step 1: warp yarns are fed longitudinally to the knitting area, with each warp yarn fed between two knitting needles; Step 2: needle cylinder looped yarns and needle dial looped yarns are fed in the weft direction to needle cylinder knitting needles and needle dial knitting needles respectively by a needle cylinder looped yarn guide and a needle dial looped yarn guide, and two weft plain stitches are formed under the effects of a needle cylinder stitch cam and a needle dial stitch cam respectively; Step 3: needle dial weft inlay yarns and needle cylinder weft inlay yarns are simultaneously inlaid, or only needle dial weft inlay yarns or only needle cylinder weft inlay yarns are inlaid, when the needle dial knitting needles and the needle cylinder knitting needles are performing loop forming; Step 4: spacer yarns are fed to the needle dial knitting needles and the needle cylinder knitting needles through a spacer yarn guide, and connect the two weft plain stitches in the form of tuck stitches under the respective effects of a needle dial tuck cam and a needle cylinder tuck cam, and simultaneously hold the warp inlay yarns, the needle dial weft inlay yarns and the needle cylinder weft inlay yarns.

The present invention resolves the technical problems by: Making use of the stationariness of circular knitting machine, needle cylinder and draw-off mechanism, the synchronous rotation of tri-pedestal, yarn guide and bobbin creel, and making use of warp inlay mechanism in combination with spacer yarns for connection at needle dial knitting needles and needle cylinder knitting needles using tuck stitches; the interval between the needle dial and the needle cylinder can be adjusted to achieve knitting of a cylindrical biaxial weft-knitted three-dimensionally structured fabric with a maximum thickness not less than 2 cm. The weft-knitted three-dimensional knit fabric provided by the present invention the advantages of structural stability, low longitudinal and lateral extensibilities, and mechanical resillience; weft inlay yarns have high material suitability and enable fabric yarns of various materials and finenesses (such as various natural fibers, chemical fibers, high-performance fibers, etc) to make full use of the advantages of various ordinary yarns or aramid fibers, high-performance polyethylene yarn and other high-performance yarns to improve the performance of three-dimensional knit spacer fabrics. The apparatus and method provided by the present invention are rationally structured and highly efficient.

BRIEF DESCRIPTION OF THE DRAWINGS

Preferred embodiments of the present invention are illustrated in the accompanying drawings as described as follows.

In FIGS. 1~6:

Figure 1:
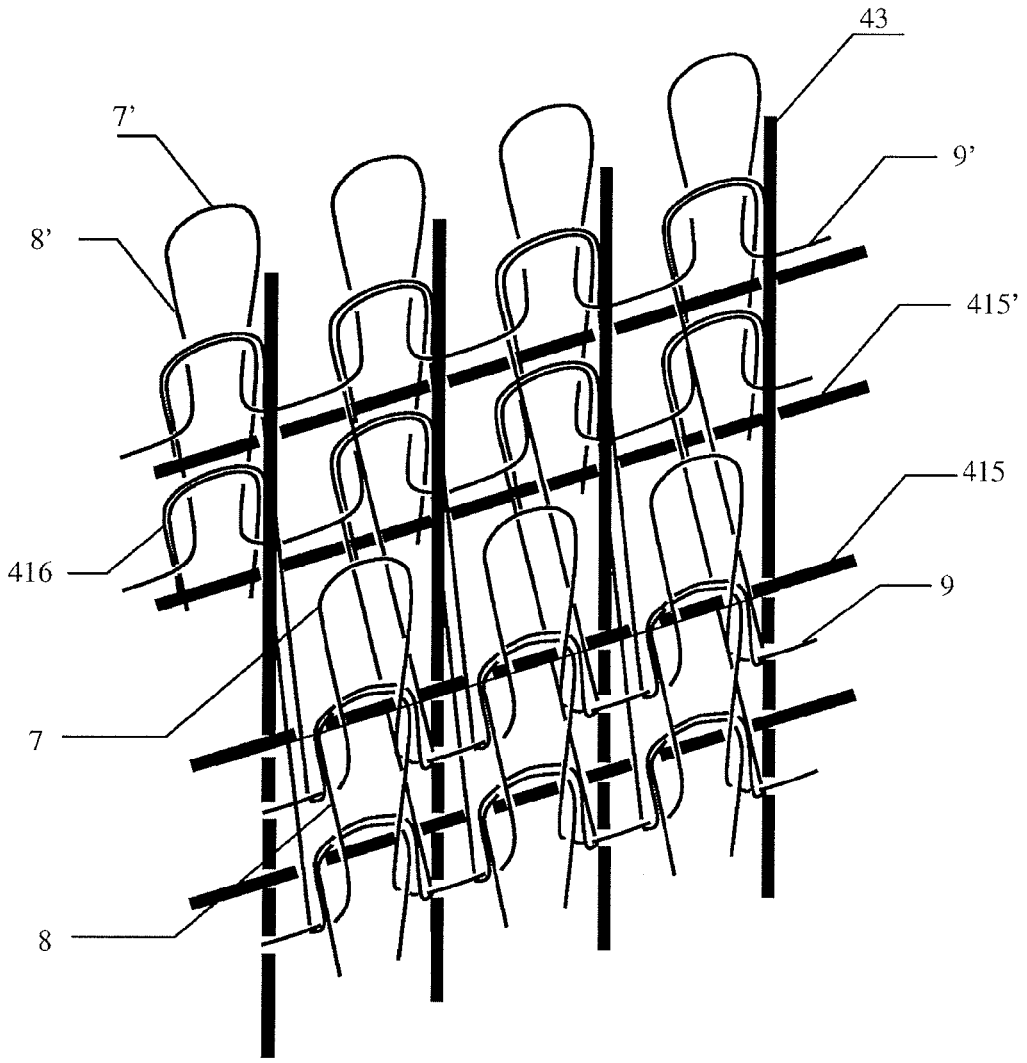
FIG. 1 is a schematic view of a cylindrical biaxial weft-knitted three-dimensional knit structure.

1 denotes a loop forming device comprising needle dial 11, needle dial tuck cam 12, needle dial stitch cam 12', needle cylinder 13, needle cylinder tuck cam 14, needle cylinder stitch cam 14', needle dial tri-pedestal 15, needle cylinder tri-pedestal 16, needle cylinder tri-pedestal disc 17, screws 18, screws 19, needle dial knitting needles and needle cylinder knitting needles.

2 denotes a transmission mechanism comprising a transmission mechanism comprising a squirrel-cage 3-phase A.C. asynchronous motor 21, a transmission belt 22, a steel track 23, a bearing 24, a bearing 24A, a bearing 24B, a pinion 25, a compensating pinion 25A, a compensating pinion 25B, a needle cylinder main gear 26, a drive shaft 27, a driven shaft 27A, a driven shaft 27B, a pinion 28, a compensating pinion 28A, a compensating pinion 28B, a needle dial main gear 29, keys 210, a needle dial tri-pedestal disc 211, a shaft sleeve 212, a hollow determinate shaft 213, a bearing 214, a bearing 215, screws 216A, screws 216B, screws 216C, keys 217, a bearing 218, a bearing 219, a bearing 219A, and a bearing 219B.

3 denotes a draw-off and take-up mechanism comprising a draw-off roller 31A, a compression roller 31B, a compression roller 31C, a torque stepper motor 32, a chain 33, a fabric roller 34 comprising a fabric roller left end 34A and a fabric roller right end 34B, a rocker lever 35, a body frame stanchion 36, a chain 37, a transmission shaft 38, a belt 39, and belt tensioner pulleys 310.

4 denotes a yarn feeding mechanism comprising a warp yarn creel 41, a yarn feeder tube 42, warp inlay yarns 43, a warp inlay yarn guide ring 44, a yarn hook 45, a warp yarn disc 46, a plurality of holes 47, bracing struts 48, a needle cylinder looped yarn guide 49, a needle dial looped yarn guide 410, a needle cylinder weft inlay yarn guide 411, a needle dial weft inlay yarn guide 412, a spacer yarn guide 413, needle cylinder looped yarns 414, needle dial looped yarns 414', needle cylinder weft inlay yarns 415, needle dial weft inlay yarns 415', spacer yarns 416, a bobbin creel 417, a bobbin creel 417', a yarn lever 418, a yarn lever 418', a yarn hook 419, and a yarn hook 419'.

5 denotes a control mechanism comprising a central control unit 51, an operation panel 52, a push button On/Off control 53, a torque motor draw-off/take-up control 54, a triangular position adjustment control 55, and a defect detection device control 56.

6 denotes a body frame comprising body frame connector screws 61, a seat 62, seat connector screws 63, a column 64, a column 65, a column 66, a top cover 67, top cover connector screws 68, column connector screws 69, a body frame platform 610, a head casing 611, and a needle dial large gear housing 612.

7 denotes a weft plain stitch (formed by the needle cylinder), and 7' denotes a weft plain stitch (formed by the needle dial).

8 denotes a yarn loop pillar (a weft plain stitch formed by the needle cylinder), and 8' denotes a yarn loop pillar (a weft plain stitch formed by the needle dial).

9 denotes a sinker loop (a weft plain stitch formed by the needle cylinder), and 9' denotes a sinker loop (a weft plain stitch formed by the needle dial).

EMBODIMENTS

Detailed Description

For better understanding of the present invention, preferred embodiments thereof are described in detail with reference to the accompanying drawings. It must be noted that these embodiments are only intended to illustrate the present invention and should not restrict the scope thereof. In addition, it must be understood that persons of ordinary skill in the art will be able to make various alterations or modifications with reference to the content hereof, and these equivalent forms shall fall within the scope of the present invention as specifically set forth in the claims appended hereto.

As shown in FIGS. 1~6, the following embodiments employ the apparatus and method of the present invention suitable for producing cylindrical biaxial weft-knitted three-dimensionally structured fabrics.

The apparatus for producing cylindrical biaxial weft-knitted three-dimensionally structured fabrics makes use of the stationariness of circular knitting machine, needle cylinder and draw-off mechanism, the synchronous rotation of tri-pedestal, yarn guide and bobbin creel, and makes use of warp inlay mechanism in combination with spacer yarns for connection at needle dial knitting needles and needle cylinder knitting needles using tuck stitches; the interval between the needle dial and the needle cylinder can be adjusted to achieve knitting of a cylindrical biaxial weft-knitted three-dimensionally structured fabric with a maximum thickness not less than 2 cm.

Embodiment 1

Double-Layered Weft Inlay Yarn Cylindrical Biaxial Weft-Knitted Three-Dimensional Knit Structure Shown in FIG. 1 is a double-layered weft inlay yarn cylindrical biaxial weft-knitted three-dimensional knit structure comprising two weft plain stitches (7, 7'), a group of spacer yarns (416), two groups of weft inlay yarns (415, 415') and a group of warp inlay yarns (43); the two groups of weft inlay yarns (415, 415') are used for weft inlay on a needle dial (11) or a needle cylinder (13), the warp inlay yarns (43) are positioned between the two groups of weft inlay yarns (415, 415'), and the two weft plain stitches (7, 7') are connected with each other by the group of spacer yarns (416) to jointly hold the warp inlay yarns (43) and the two groups of weft inlay yarns (415, 415') together, in order to form a biaxial weft-knitted three-dimensional knit structure.

Needle dial looped yarns (414') are fed into knitting needles of the needle dial through a needle dial looped yarn guide (410) and a weft plain stitch (7') is formed under the effect of a needle dial stitch cam (12'); needle cylinder looped yarns (414) are fed into knitting needles of the needle cylinder through a needle cylinder looped yarn guide (49) and a weft plain stitch (7) is formed under the effect of a needle cylinder stitch cam (14').

The weft inlay yarns (415) are inlaid into the weft plain stitch (7) in a straight way; the weft inlay yarns (415') are inlaid into the weft plain stitch (7') in a straight way; the warp inlay yarns (43) are inlaid between each longitudinal row along the face side of the looped yarn and each longitudinal row along the reverse side of the looped yarn in a straight way, and are held by one group of weft inlay yarns (415) or (415') or two groups of weft inlay yarns (415, 415') and the spacer yarns (416); the weft inlay yarns (415) are located on the reverse sides of the yarn loop pillar (8) and sinker loop (9) of the weft plain stitch (7); weft inlay yarns (415') are located on the reverse sides of the yarn loop pillar (8') and sinker loop (9') of the weft plain stitch (7'); the warp inlay yarns (43) are located between two groups of weft inlay yarns (415, 415') or on the reverse sides of one group of weft inlay yarns (415) or on the front sides of one group of weft inlay yarns (415').

The spacer yarns (416) are fed into knitting needles of the needle dial and knitting needles of the needle cylinder through a spacer yarn guide (413) and connect the weft plain stitch (7) and the weft plain stitch (7') in the form of tuck stitches under the respective effects of a needle dial tuck cam (12) and a needle cylinder tuck cam (14), and hold the weft inlay yarns (415) and/or the weft inlay yarns (415'), the warp inlay yarns (43), thereby forming a biaxial weft-knitted three-dimensional knit structure.

Figure 2:
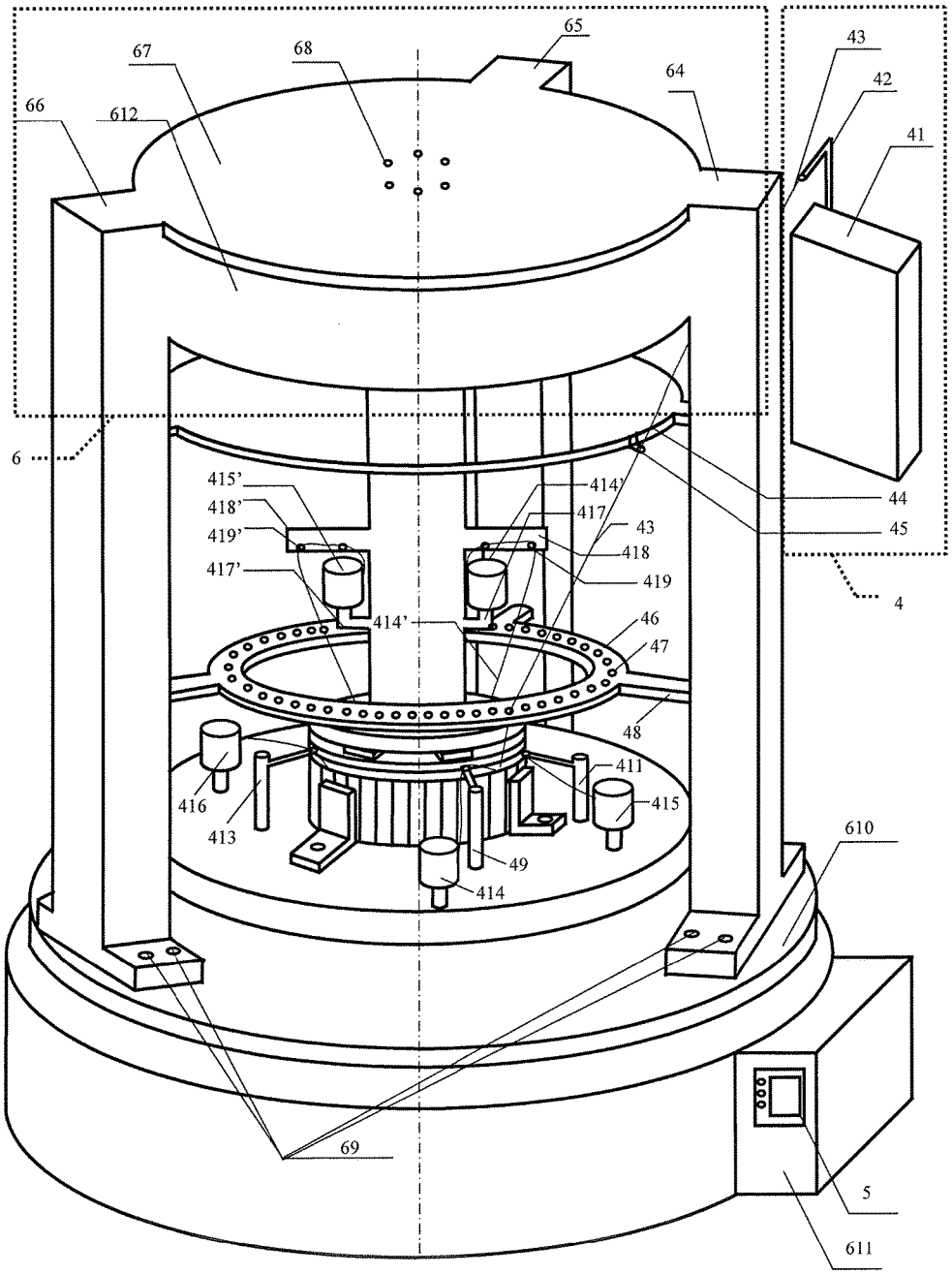
FIG. 2 is an isometric schematic view of an apparatus for producing cylindrical biaxial weft-knitted three-dimensional knit structure.
Figure 3:
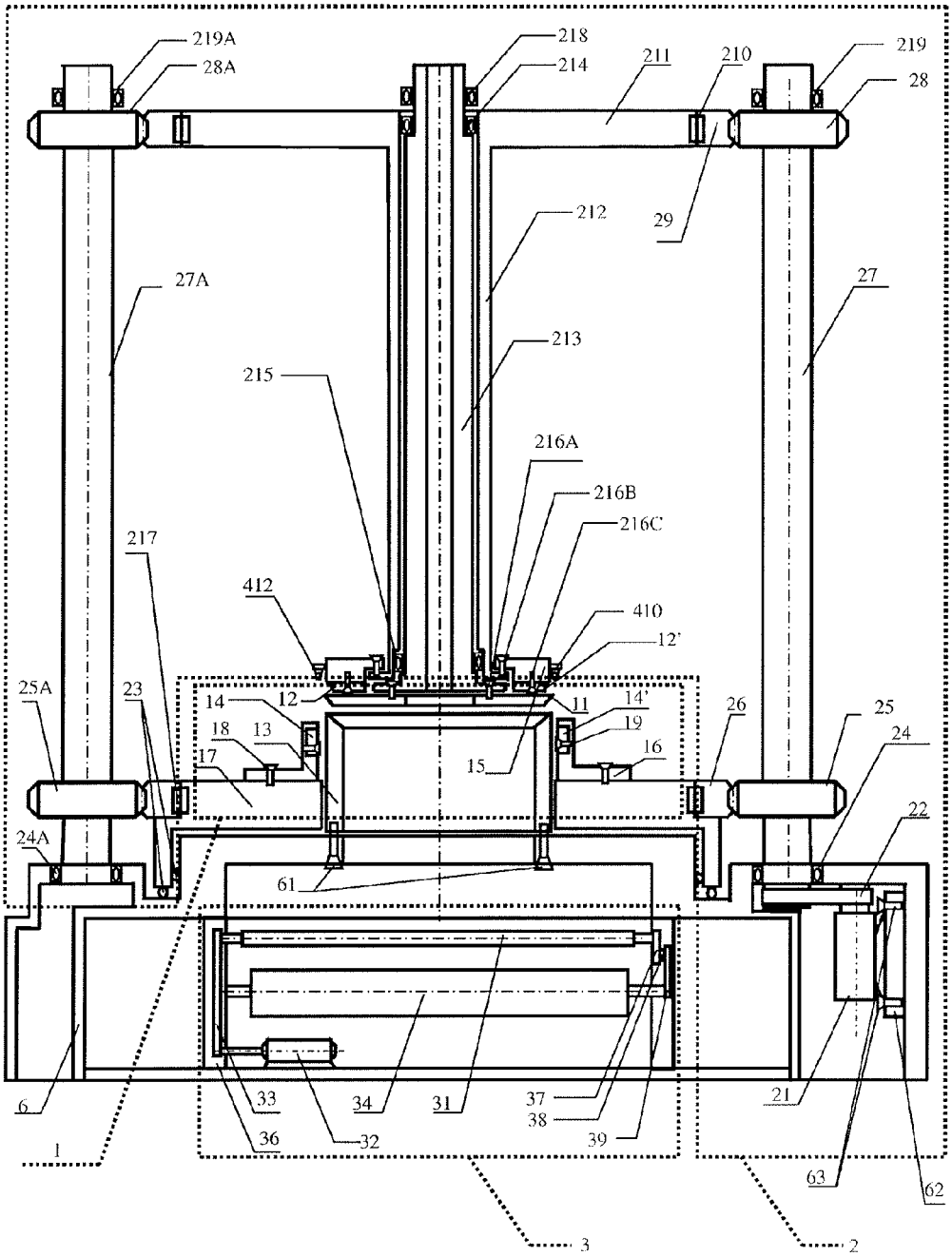
FIG. 3 is a schematic view illustrating transmission of the apparatus for producing cylindrical biaxial weft-knitted three-dimensional knit structure.
Figure 4:
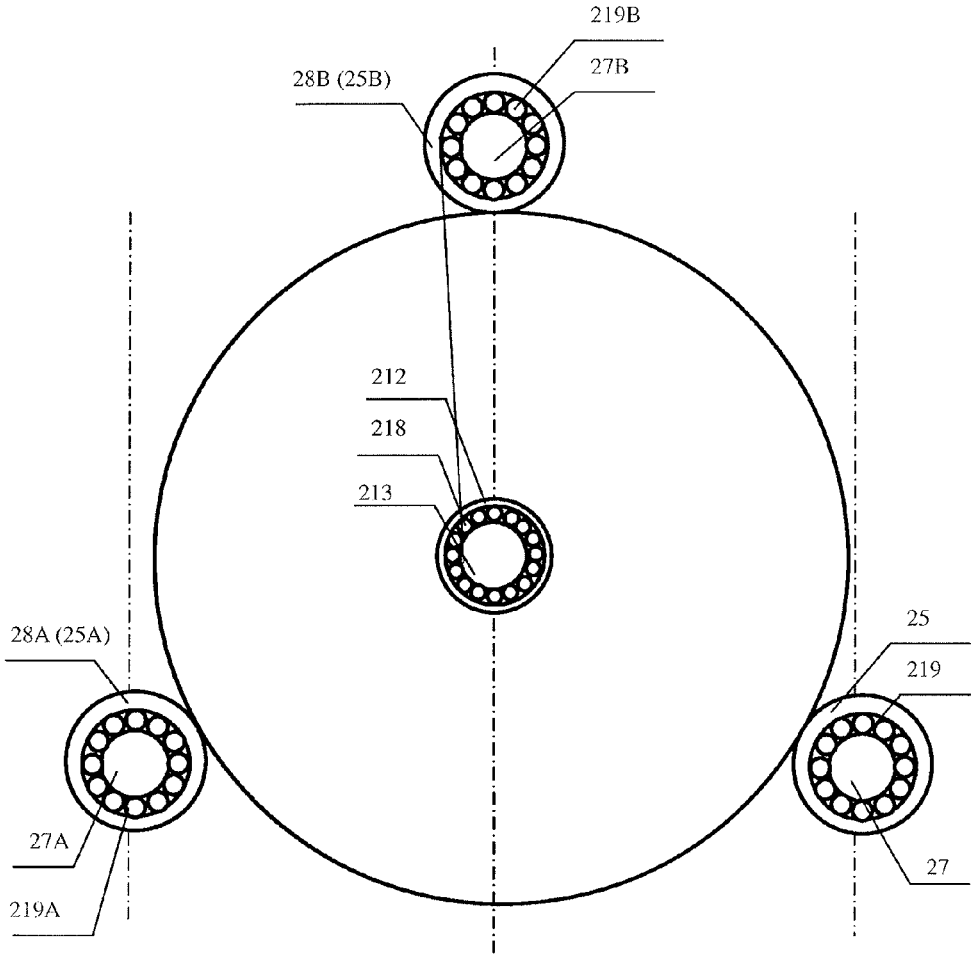
FIG. 4 is a plan view illustrating transmission of the apparatus for producing cylindrical biaxial weft-knitted three-dimensional knit structure.
Figure 5:
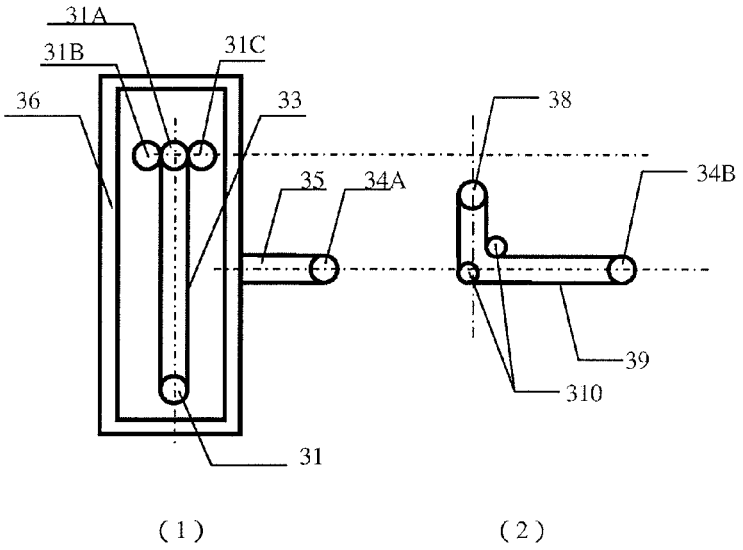
FIG. 5 is a schematic view illustrating a draw-off and take-up mechanism of the apparatus for producing cylindrical biaxial weft-knitted three-dimensional knit structure.
Figure 6:
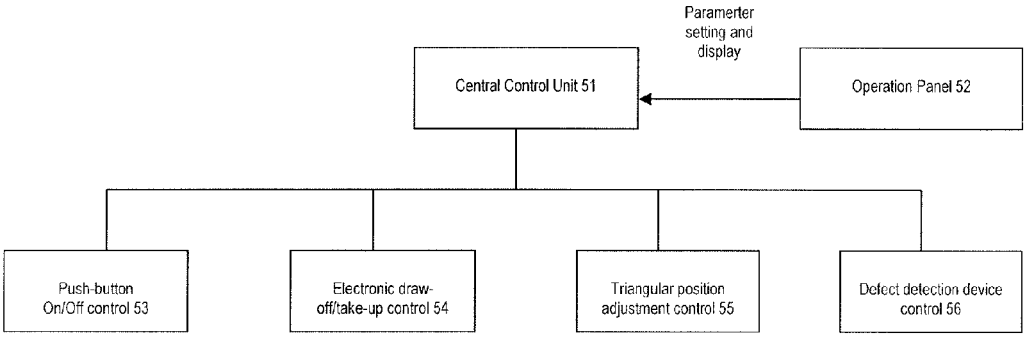
FIG. 6 is a flow chart illustrating the work flow of a control mechanism of the apparatus for producing cylindrical biaxial weft-knitted three-dimensional knit structure.

FIG. 2 is an isometric schematic view of an apparatus for producing cylindrical biaxial weft-knitted three-dimensional knit structure; FIG. 3 is a schematic view illustrating transmission of the apparatus for producing cylindrical biaxial weft-knitted three-dimensional knit structure; FIG. 4 is a plan view illustrating transmission of the apparatus for producing cylindrical biaxial weft-knitted three-dimensional knit structure; FIG. 5 is a schematic view illustrating a draw-off and take-up mechanism of the apparatus for producing cylindrical biaxial weft-knitted three-dimensional knit structure; FIG. 6 is a flow chart illustrating the work flow of a control mechanism of the apparatus for producing cylindrical biaxial weft-knitted three-dimensional knit structure. The apparatus for producing fabrics having the cylindrical biaxial weft-knitted three-dimensional knit structure comprises a loop forming device (1), a transmission mechanism (2), a draw-off and take-up mechanism (3), a yarn feeding mechanism (4), a control mechanism (5), and a body frame (6).

The loop forming device (1) comprises a needle dial (11), a needle cylinder (13), needle dial knitting needles, needle cylinder knitting needles, a needle dial tuck cam (12), a needle cylinder tuck cam (14), a needle dial tri-pedestal (15), a needle cylinder tri-pedestal (16), a needle cylinder tri-pedestal disc (17), the needle dial tuck cam (12) and a needle dial stitch cam (12') being connected to the needle dial tri-pedestal (15) by means of screws (216C), the needle cylinder tuck cam (14) and a needle cylinder stitch cam (14') being connected to the needle cylinder tri-pedestal (16) by means of screws (19), the needle cylinder tri-pedestal (16) being connected to the needle cylinder tri-pedestal disc (17) by means of screws (18); the needle dial stitch cam (12') controls the needle dial knitting needles to knit the weft plain stitch (7') by loop formation; the needle cylinder stitch cam (14') controls the needle cylinder knitting needles to knit the weft plain stitch (7) by loop formation; the needle dial tuck cam (12) and the needle cylinder tuck cam (14) control the needle dial knitting needles and the needle cylinder knitting needles to form a double-sided structure with a tuck height for connecting the weft plain stitch (7) and the weft plain stitch (7').

The transmission mechanism (2) comprises a squirrel-cage 3-phase A.C. asynchronous motor (21) fixed on the seat (62) by means of the seat connector screws (63), a drive shaft (27) driven by the A.C. asynchronous motor (21) with a belt (22), the drive shaft (27) being provided with two identical pinions (25) and (28), the pinions (25) and (28) being engaged respectively with a needle cylinder main gear (26) and a needle dial main gear (29) which are identical, the needle cylinder main gear (26) being connected with the needle cylinder tri-pedestal disc (17) by means of keys (217), the needle cylinder main gear (26) and the needle cylinder tri-pedestal disc (17) being driven by the pinion (25) on the drive shaft (27) to rotate along a steel track (23) located at a recess on the body frame (6); the needle dial main gear (29) is connected with a needle dial tri-pedestal disc (211) by means of keys (210), the needle dial tri-pedestal disc (211) being fixedly connected with the upper end of the shaft sleeve (212), the lower end of the shaft sleeve (212) being connected with the needle dial tri-pedestal (15) by means of screws (216B), and the needle dial main gear (29) rotates under the effects of the A.C. asynchronous motor (21), the drive shaft (27) and the pinion (28); the needle cylinder main gear (26) and the needle dial main gear (29) rotate synchronously with one another; to ensure the synchronism between the needle dial tri-pedestal (15) and needle cylinder tri-pedestal (16) and the invariance of clearances between the needle cylinder tuck cam (14) and the needle cylinder (13) and between the needle cylinder stitch cam (14') and the needle cylinder (13) during operation, compensating pinions (25A) and (28A) are provided on a driven shaft (27A) and compensating pinions (25B) and (28B) are provided on a driven shaft (27B), the driven shafts (27A) and (27B) rotate under the effects of the needle cylinder main gear (26) and the needle dial main gear (29) and are connected with the body frame (6) by means of bearings (24A) and (24B), and the uniform distribution of the compensating pinions (25A, 28A, 25B, 28B) and the driven shafts (27A, 27B) circumferentially with respect to the needle cylinder main gear (26) and the needle dial main gear (29) helps to improve the torsional rigidity between the needle cylinder tri-pedestal disc (17) and the needle dial tri-pedestal disc (211), reduce transmission gap and ensure the synchronism between the needle cylinder main gear (26) and the needle dial main gear (29); a bearing (214) is installed on a hollow determinate shaft (213) and positioned using a bearing shoulder; a bearing (215) is installed on the determinate shaft (213) and positioned using a bearing shoulder; interference fit of the bearings (214, 215) and the shaft sleeve (212) ensures that the needle dial main gear (29) is driven by the pinion (28) on the drive shaft (27) to rotate the shaft sleeve (212); the upper end of the determinate shaft (213) is connected with the needle dial large gear housing (612) by means of a bearing (218) and connected to the top cover (67) of the body frame (6) by means of the top cover connector screws (68), while the lower end of the determinate shaft (213) is connected with the needle dial (11) by means of screws (216A); the upper ends of the drive shaft (27) and the driven shafts (27A, 27B) are connected with the needle dial large gear housing (612) by means of bearings (219, 219A, 219B) respectively, and the lower ends thereof are connected with the body frame (6) by means of the bearings (24, 24A, 24B) respectively.

The draw-off and take-up mechanism (3) comprises a draw-off roller (31A), a compression roller (31B) and a compression roller (31C) with both ends of each of the three rollers engaged with gear transmission, and the draw-off roller (31A) being driven by the left end of a torque stepper motor (32) through a chain (33); a fabric roller (34) protruding out of a body frame stanchion (36) through a rocker lever (35), with a fabric roller left end (34A) located on the same side as the chain (33), the right end of the draw-off roller (31A) drives a fabric roller right end (34B) through a chain (37), a transmission shaft (38) and a belt (39), and the tension of the belt can be adjusted by changing the locations of the belt tensioner pulleys (310).

The yarn feeding mechanism (4) comprises a needle cylinder looped yarn guide (49), a needle dial looped yarn guide (410), a needle cylinder weft inlay yarn guide (411), a needle dial weft inlay yarn guide (412) and a spacer yarn guide (413) which are arranged counterclockwisely; the yarn feeding mechanism (4) further comprises a warp yarn disc (46) with a plurality of holes (47) uniformly distributed thereon, the warp yarn disc (46) being connected with three columns (64, 65, 66) through three uniformly distributed bracing struts (48); warp inlay yarns (43) are dispensed from a warp yarn creel (41) through a yarn feeder tube (42) and pass through a yarn hook (45) on a warp inlay yarn guide ring (44) and then penetrate through the holes (47) on the warp yarn disc (46); needle cylinder looped yarns (414) are kept in a cylinder plugged on the needle cylinder tri-pedestal disc (17), and are then fed to the loop forming system (1); needle dial looped yarns (414') are kept in a cylinder plugged on a bobbin creel (417) fixedly connected with a shaft sleeve (212) and reach the needle dial looped yarn guide (410) through a yarn hook (419) on a yarn lever (418), and are then fed to the loop forming system (1); needle cylinder weft inlay yarns (415) are kept in a cylinder plugged on the needle cylinder tri-pedestal disc (17), and are then inlaid between the warp inlay yarns (43) and the needle cylinder looped yarns through the needle cylinder weft inlay yarn guide (411); needle dial weft inlay yarns (415') are kept in a cylinder plugged on a bobbin creel (417') fixedly connected with the shaft sleeve (212) and reach the needle dial weft inlay yarn guide (412) through a yarn hook (419') on a yarn lever (418'), and are then inlaid between the warp inlay yarns (43) and the needle dial looped yarns; spacer yarns (416) are kept in a cylinder plugged on the needle cylinder tri-pedestal disc (17), and are then the loop forming system (1) through the spacer yarn guide (413); the needle cylinder looped yarn guide (49), the needle cylinder weft inlay yarn guide (411), needle cylinder looped yarns (414), needle cylinder weft inlay yarns (415), spacer yarns (416), the needle cylinder tuck cam (14), the needle cylinder stitch cam (14') and the needle cylinder tri-pedestal (16), and the needle dial looped yarn guide (410), the needle dial weft inlay yarn guide (412), needle dial looped yarns (414'), needle dial weft inlay yarns (415'), the needle dial tuck cam (12), the needle dial stitch cam (12') and the needle dial tri-pedestal (15) rotate synchronously with the needle cylinder tri-pedestal disc (17) and a needle dial tri-pedestal disc (211), respectively.

The control mechanism (5) comprises a central control unit (51), an operation panel (52), a push button On/Off control (53), a torque motor draw-off/take-up control (54), a triangular position adjustment control (55), and a defect detection device control (56). The central control unit (51) and the operation panel (52) are integrated to form an integrated control panel comprising microprocessors and integrated control circuits, thus enabling convenient parameter setting, reliable push-button operation, intuitive indication of information, display of instant operational data and failure causes, and direct input of some process parameters and operating instructions.

The body frame (6) comprises body frame connector screws (61), a seat (62) fixedly connected with the body frame (6), seat connector screws (63), three columns (64, 65, 66) evenly distrubuted circumferentially, a top cover (67), top cover connector screws (68), column connector screws (69) fastening the columns onto a body frame platform (610), a head casing (611), and a needle dial large gear housing (612).

The needle dial (11), the needle cylinder (13) and the draw-off and take-up mechanism (3) are fixed, and the needle dial (11) is connected to the determinate shaft (213) by means of the screws (216A) and the needle cylinder (13) is connected to the body frame (6) by means of the body frame connector screws (61); the stanchion (36) of the draw-off and take-up mechanism (3) is fixedly installed on the body frame (6); the interval between the needle dial (11) and the needle cylinder (13) can be adjusted to achieve knitting of a cylindrical biaxial weft-knitted three-dimensionally structured fabric with a maximum thickness not less than 2 cm.

A method for producing a double-layered weft inaly yarn cylindrical biaxial weft-knitted three-dimensional knit structure, comprising the following steps: Step 1: warp yarns are fed longitudinally to the knitting area, with each warp yarn fed between two knitting needles, as shown in FIG. 1; Step 2: needle cylinder looped yarns (414) and needle dial looped yarns (414') are fed in the weft direction to needle cylinder knitting needles and needle dial knitting needles respectively by a needle cylinder looped yarn guide (49) and a needle dial looped yarn guide (410), and two weft plain stitches (7, 7') are formed under the effects of a needle cylinder stitch cam (14') and a needle dial stitch cam (12') respectively, as shown in FIG. 2 and FIG. 3; Step 3: needle dial weft inlay yarns (415') and needle cylinder weft inlay yarns (415) are simultaneously inlaid when the needle dial knitting needles and the needle cylinder knitting needles are performing loop forming; Step 4: spacer yarns (416) are fed to the needle dial knitting needles and the needle cylinder knitting needles through a spacer yarn guide (413), and connect the weft plain stitch (7) and the weft plain stitch (7') in the form of tuck stitches under the respective effects of a needle dial tuck cam (12) and a needle cylinder tuck cam (14), and simultaneously hold the warp inlay yarns (43), the needle dial weft inlay yarns (415') and the needle cylinder weft inlay yarns (415), thereby forming a double-layered weft inlay yarn cylindrical biaxial weft-knitted three-dimensional knit structure.

Embodiment 2

Single-Layered Weft Inlay Yarn Cylindrical Biaxial Weft-Knitted Three-Dimensional Knit Structure The apparatus for producing cylindrical biaxial weft-knitted three-dimensional knit structure described in Embodiment 1 is used for knitting. Step 1: warp yarns are fed longitudinally to the knitting area, with each warp yarn fed between two knitting needles; Step 2: needle cylinder looped yarns (414) and needle dial looped yarns (414') are fed in the weft direction to needle cylinder knitting needles and needle dial knitting needles respectively by a needle cylinder looped yarn guide (49) and a needle dial looped yarn guide (410), and two weft plain stitches (7, 7') are formed under the effects of a needle cylinder stitch cam (14') and a needle dial stitch cam (12') respectively; Step 3: needle cylinder weft inlay yarns (415) are simultaneously inlaid when the needle dial knitting needles and the needle cylinder knitting needles are performing loop forming; Step 4: spacer yarns (416) are fed to the needle dial knitting needles and the needle cylinder knitting needles through a spacer yarn guide (413), and connect the weft plain stitch (7) and the weft plain stitch (7') in the form of tuck stitches under the respective effects of a needle dial tuck cam (12) and a needle cylinder tuck cam (14), and simultaneously hold the warp inlay yarns (43) and the needle cylinder weft inlay yarns (415), thereby forming a single-layered weft inlay yarn cylindrical biaxial weft-knitted three-dimensional knit structure.

What is claimed is:

1. An apparatus for producing fabric with a cylindrical biaxial weft-knitted three-dimensional knit structure, comprising a loop forming device, a transmission mechanism, a draw-off and take-up mechanism, a yarn feeding mechanism, a control mechanism, and a body frame; wherein:

the body frame comprises body frame connector screws, a seat fixedly connected with the body frame, seat connector screws, three columns evenly distributed circumferentially, a top cover, top cover connector screws, column connector screws fastening the columns onto a body frame platform, a head casing, and a needle dial large gear housing;

the loop forming device comprises a needle dial, a needle cylinder, needle dial knitting needles, needle cylinder knitting needles, a needle dial tuck cam, a needle cylinder tuck cam, a needle dial tri-pedestal, a needle cylinder tri-pedestal, a needle cylinder tri-pedestal disc, the needle dial tuck cam and a needle dial stitch cam being connected to the needle dial tri-pedestal by means of screws, the needle cylinder tuck cam and a needle cylinder stitch cam being connected to the needle cylinder tri-pedestal by means of screws, the needle cylinder tri-pedestal being connected to the needle cylinder tri-pedestal disc by means of screws; the needle dial stitch cam controls the needle dial knitting needles to knit the weft plain stitch by loop formation; the needle cylinder stitch cam controls the needle cylinder knitting needles to knit the weft plain stitch by loop formation; the needle dial tuck cam and the needle cylinder tuck cam control the needle dial knitting needles and the needle cylinder knitting needles to form a double-sided structure with a tuck height for connecting the weft plain stitch and the weft plain stitch;

the yarn feeding mechanism comprises a needle cylinder looped yarn guide, a needle dial looped yarn guide, a needle cylinder weft inlay yarn guide, a needle dial weft inlay yarn guide and a spacer yarn guide which are arranged counterclockwise; the yarn feeding mechanism further comprises a warp yarn disc with a plurality of holes uniformly distributed thereon, the warp yarn disc being connected with three columns through three uniformly distributed bracing struts; warp inlay yarns are dispensed from a warp yarn creel through a yarn feeder tube and pass through a yarn hook on a warp inlay yarn guide ring and then penetrate through the holes on the warp yarn disc; needle cylinder looped yarns are kept in a cylinder plugged on the needle cylinder tri-pedestal disc, and are then fed to the loop forming system; needle dial looped yarns are kept in a cylinder plugged on a bobbin creel fixedly connected with a shaft sleeve and reach the needle dial looped yarn guide through a yarn hook on a yarn lever, and are then fed to the loop forming system; needle cylinder weft inlay yarns are kept in a cylinder plugged on the needle cylinder tri-pedestal disc, and are then inlaid between the warp inlay yarns and the needle cylinder looped yarns through the needle cylinder weft inlay yarn guide; needle dial weft inlay yarns are kept in a cylinder plugged on a bobbin creel fixedly connected with the shaft sleeve and reach the needle dial weft inlay yarn guide through a yarn hook on a yarn lever, and are then inlaid between the warp inlay yarns and the needle dial looped yarns; spacer yarns are kept in a cylinder plugged on the needle cylinder tri-pedestal disc, and are then the loop forming system through the spacer yarn guide; the needle cylinder looped yarn guide, the needle cylinder weft inlay yarn guide, needle cylinder looped yarns, needle cylinder weft inlay yarns, spacer yarns, the needle cylinder tuck cam, the needle cylinder stitch cam and the needle cylinder tri-pedestal, and the needle dial looped yarn guide, the needle dial weft inlay yarn guide, needle dial looped yarns, needle dial weft inlay yarns, the needle dial tuck cam, the needle dial stitch cam and the needle dial tri-pedestal rotate synchronously with the needle cylinder tri-pedestal disc and a needle dial tri-pedestal disc, respectively;

the transmission mechanism comprises a squirrel-cage 3-phase A.C. asynchronous motor fixed on the seat by means of the seat connector screws, a drive shaft driven by the A.C. asynchronous motor with a belt, the drive shaft being provided with two identical pinions, the pinions being engaged respectively with a needle cylinder main gear and a needle dial main gear which are identical, the needle cylinder main gear being connected with the needle cylinder tri-pedestal disc by means of keys, the needle cylinder main gear and the needle cylinder tri-pedestal disc being driven by the pillion on the drive shaft to rotate along a steel track located at a recess on the body frame; the needle dial main gear is connected with a needle dial tri-pedestal disc by means of keys, the needle dial tri-pedestal disc being fixedly connected with the upper end of the shaft sleeve, the lower end of the shaft sleeve being connected with the needle dial tri-pedestal by means of screws, and the needle dial main gear rotates under the effects of the A.C. asynchronous motor, the drive shaft and the pinion; the needle cylinder main gear and the needle dial main gear rotate synchronously with one another; to ensure the synchronism between the needle dial tri-pedestal and needle cylinder tri-pedestal and the invariance of clearances between the needle cylinder tuck cam and the needle cylinder and between the needle cylinder stitch cam and the needle cylinder during operation, compensating pinions are provided on a driven shaft and compensating pinions are provided on a driven shaft, the driven shafts rotate under the effects of the needle cylinder main gear and the needle dial main gear and are connected with the body frame by means of bearings, and the uniform distribution of the compensating pinions and the driven shafts circumferentially with respect to the needle cylinder main gear and the needle dial main gear helps to improve the torsional rigidity between the needle cylinder tri-pedestal disc and the needle dial tri-pedestal disc, reduce transmission gap and ensure the synchronism between the needle cylinder main gear and the needle dial main gear; a bearing is installed on a hollow determinate shaft and positioned using a bearing shoulder; a bearing is installed on the determinate shaft and positioned using a bearing shoulder; interference fit of the bearings and the shaft sleeve ensures that the needle dial main gear is driven by the pinion on the drive shaft to rotate the shaft sleeve; the upper end of the determinate shaft is connected with the needle dial large gear housing by means of a bearing and connected to the top cover of the body frame by means of the top cover connector screws, while the lower end of the determinate shaft is connected with the needle dial by means of screws; the upper ends of the drive shaft and the driven shafts are connected with the needle dial large gear housing by means of bearings respectively, and the lower ends thereof are connected with the body frame by means of the bearings respectively;

the draw-off and take-up mechanism comprises a draw-off roller, a compression roller and a compression roller with both ends of each of the three rollers engaged with gear transmission, and the draw-off roller being driven by the left end of a torque stepper motor through a chain; a fabric roller protruding out of a body frame stanchion through a rocker lever, with a fabric roller left end located on the same side as the chain, the right end of the draw-off roller drives a fabric roller right end through a chain, a transmission shaft and a belt, and the tension of the belt can be adjusted by changing the locations of the belt tensioner pulleys;

the control mechanism comprises a central control unit, an operation panel, a push button On/Off control, a torque motor draw-off/take-up control, a triangular position adjustment control, and a defect detection device control;

the cylindrical biaxial weft-knitted three-dimensional knit structure, comprising two weft plain stitches, a group of spacer yarns, two groups of weft inlay yarns and a group of warp inlay yarns, wherein the two groups of weft inlay yarns are used for the selective weft inlay on a needle dial or a needle cylinder, the warp inlay yarns are positioned between the two groups of weft inlay yarns, and the two weft plain stitches are connected with each other by the group of spacer yarns to jointly hold the warp inlay yarns and one group of weft inlay yarns or both the two groups of weft inlay yarns together, in order to form a biaxial weft-knitted three-dimensional knit structure.

2. The apparatus for producing fabric with a cylindrical biaxial weft-knitted three-dimensional knit structure as defined in claim 1, wherein needle dial looped yarns are fed into knitting needles of the needle dial through a needle dial looped yarn guide and a weft plain stitch is formed under the effect of a needle dial stitch cam; needle cylinder looped yarns are fed into knitting needles of the needle cylinder through a needle cylinder looped yarn guide and a weft plain stitch is formed under the effect of a needle cylinder stitch cam.

3. The apparatus for producing fabric with a cylindrical biaxial weft-knitted three-dimensional knit structure as defined in claim 1, wherein the weft inlay yarns are inlaid into the weft plain stitch in a straight way; the weft inlay yarns are inlaid into the weft plain stitch in a straight way; the warp inlay yarns are inlaid between each longitudinal row along the face side of the looped yarn and each longitudinal row along the reverse side of the looped yarn in a straight way, and are held by one group of weft inlay yarns or two groups of weft inlay yarns and the spacer yarns; the weft inlay yarns are located on the reverse sides of the yarn loop pillar and sinker loop of the weft plain stitch; weft inlay yarns are located on the reverse sides of the yarn loop pillar and sinker loop of the weft plain stitch; the warp inlay yarns are located between two groups of weft inlay yarns or on the reverse sides of one group of weft inlay yarns or on the front sides of one group of weft inlay yarns.

4. The apparatus for producing fabric with a cylindrical biaxial weft-knitted three-dimensional knit structure as defined in claim 1, wherein the spacer yarns are fed into knitting needles of the needle dial and knitting needles of the needle cylinder through a spacer yarn guide and connect the weft plain stitch and the weft plain stitch in the form of tuck stitches under the respective effects of a needle dial tuck cam and a needle cylinder tuck cam, and hold the weft inlay yarns and/or the weft inlay yarns, the warp inlay yarns, thereby forming a biaxial weft-knitted three-dimensional knit structure.

5. The apparatus for producing fabric with a cylindrical biaxial weft-knitted three-dimensional knit structure as defined in claim 4, wherein the needle dial, the needle cylinder and the draw-off and take-up mechanism are fixed, and the needle dial is connected to the determinate shaft by means of the screws and the needle cylinder is connected to the body frame by means of the body frame connector screws; the stanchion of the draw-off and take-up mechanism is fixedly installed on the body frame; the interval between the needle dial and the needle cylinder can be adjusted to achieve knitting of a cylindrical biaxial weft-knitted three-dimensionally structured fabric with a maximum thickness not less than 2 cm.

* * * * *